United States Patent [19]

Kanno

[11] Patent Number: 4,907,322

[45] Date of Patent: Mar. 13, 1990

[54] ADORNMENT DEVICE

[76] Inventor: Kiyohiro Kanno, Dai-Ni Ofuna Park Town C-613, 521, Kasama-cho, Sakae-ku, Yokohama-shi, Kanagawa-ken, Japan

[21] Appl. No.: 178,358

[22] Filed: Apr. 6, 1988

[30] Foreign Application Priority Data

Apr. 6, 1987 [JP] Japan ..... 62-50991

[51] Int. Cl.[4] ..... A44C 11/00; A44B 11/25

[52] U.S. Cl. ..... 24/616; 24/116 A; 24/135 N

[58] Field of Search ..... 24/3 A, 3 C, 135 N, 24/135 R, 616, 618, 580, 116 A; 403/340; 63/4

[56] References Cited

U.S. PATENT DOCUMENTS

| | | | |
|---|---|---|---|
| 904,603 | 11/1908 | Crocker | 403/340 |
| 1,057,484 | 4/1913 | Huber | 24/135 N |
| 1,412,731 | 4/1922 | Wormser | 24/616 |
| 1,575,161 | 3/1926 | Grode . | |
| 1,626,138 | 4/1927 | Kohn . | |
| 1,771,125 | 7/1930 | Kahle | 24/116 A |
| 2,402,861 | 6/1946 | Winnick | 24/135 N |
| 2,660,092 | 11/1953 | Bloom | 24/3 C |
| 2,835,945 | 5/1958 | Hilsinger | 24/3 C |
| 3,802,011 | 4/1974 | Castagnola | 24/3 A |
| 4,041,562 | 8/1977 | Nealy | 24/3 A |
| 4,342,477 | 8/1982 | McClure | 24/135 N |

FOREIGN PATENT DOCUMENTS

| | | | |
|---|---|---|---|
| 0250321 | 12/1987 | European Pat. Off. . | |
| 8700964 | 4/1987 | Fed. Rep. of Germany . | |
| 472684 | 12/1914 | France | 24/616 |
| 1106233 | 12/1955 | France . | |
| 25390 | 4/1909 | United Kingdom | 24/135 N |

*Primary Examiner*—Victor N. Sakran
*Attorney, Agent, or Firm*—Staas & Halsey

[57] ABSTRACT

An adornment device including a flexible cord using a plurality of wires as a core and a flexible coating for coating the cord so as to impart flexibility to the cord; a retainer having a cord-threading hole through which the cord is inserted once before a clasp and through which the cord is inserted again after being bent at a bending point; and a setscrew which, by making use of the characteristics of the flexible coating material, is adapted to secure the cord to the retainer while adjustment of the tension of the cord is being made.

11 Claims, 13 Drawing Sheets

ADORNMENT DEVICE

BACKGROUND OF THE INVENTION

1. Field of the Invention

The present invention relates to an adornment device, and more particularly to an adornment device for use in, for instance, a necklace or the like adorned with jewels.

2. Description of the Related Art

Conventionally, in this type of device, a cord made of a material such as silk yarn, chemical fibers, or stainless steel is generally used as a means of connecting jewels, including pearls, into the form of a chain.

Referring to FIG. 1, a description will be given of an adornment device for connecting pieces of jewelry into the form of a chain by using a silk cord.

For instance, an adornment device 101 shown in FIG. 1 is arranged such that ends of a silk cord 102 are connected to each other by means of a clasp 14. In addition, this clasp 14 is provided with a pair of cord-hooking rings 15, 15 for hooking end portions of the cord 102 thereon.

As shown in FIG. 1, the silk cord 102, after being inserted through each of the cord-hooking rings 15, 15 and doubled back, is inserted into a cord hole 103*a* of a first pearl 103 located adjacent to the clasp 14. A first knot 102*a* is then formed after the silk cord 102 has come out of the cord hole 103*a*. Further, the silk cord 102 is inserted through the cord hole of an adjacent pearl 103, and a second knot 102*a* is formed in the same way as the knot 102*a*. In addition, a cord portion 102*b* remaining after a second knot 102*a* is formed is cut at a position in which the cord 102 comes out of the cord hole 103*a* of a following third pearl 103.

The knots 102*a* of the cord 102 are provided between the first and second pearls and the second and third pearls as viewed from the clasp 14, respectively, so as to secure the connection of the pearls by means of the silk cord 102.

However, it goes without saying that, when the pearls are connected into the form of a chain by means of the silk cord or those made of chemical fibers, the formation of cord knots with the cord stretched tightly between pearls is a troublesome operation and requires a great deal of skill.

In addition, even if the pearls are connected to one another securely by the cord, since the cord becomes elongated while in use, slackness occurs between the adjacent pearls, so that the beauty and attractiveness of the pearls are deminished. In addition, as a result of the elongation of the cord, a frequent occurrence is difficulties caused by the cord breaking.

Referring next to FIG. 2, a description will be given of an adornment device for connecting pieces of jewelry into the form of a chain by using a wire formed of a metal, such as stainless steel. Incidentally, when a wire formed from a metal is used, the ends of the cord are retained by a welding technique. For instance, spot welding is used in many cases.

In an adornment device 111 shown in FIG. 2, a U-shaped pin 113 is inserted through the cord-hooking rings provided on the clasp 14, in the same way as the above-described conventional example. Opposite end portions of this U-shaped pin 113 are respectively fitted into pin insertion guide holes 112*a* of an externally threaded portion 112. Caulked portions 113*a* at the tips of the U-shaped pin 113 are caulked to prevent the U-shaped pin 113 from coming off the externally threaded portion 112.

Meanwhile, a stainless steel cord 115 is inserted into pearls 119 in the form of a chain, and through elastic rings 118 which are provided between the adjacent pearls 119 so as not to damage the pearls 119. After the stainless steel cord 115 is inserted into the last elastic ring 118, the stainless steel cord 115 is inserted into an internally threaded portion 117, and a tip portion of the stainless steel cord 115 is inserted into a stopper 116. The portion of the stopper 116 into which the stainless steel cord 115 has been inserted is provided with spot welding to secure the stopper 116 to the stainless steel cord 115, thereby preventing the internally threaded portion 117 from coming off the stainless steel cord 115.

Subsequently, the internally threaded portion 117 is fitted into an adornment ring 114. In this inserted state, the internally threaded portion 117 and the externally threaded portion 112 are threadingly engaged with each other so as to connect one end of the stainless steel cord 115 to the clasp 14. The adornment device 111 is thus assembled.

When an adornment device using a stainless steel cord is thus assembled, a welding technique and a welding apparatus are required, so that the assembly becomes troublesome to laymen. It goes without saying that replacement of the cord is similarly troublesome. In a welding process, there are many cases where the operation is entrusted to experts specialized in welding, so that the replacement costs become high.

Furthermore, when a metal wire is used, there is a drawback in that once the metal wire is welded, it is impossible to assemble the adornment device while the wire length is being adjusted.

SUMMARY OF THE INVENTION

Accordingly, an object of the present invention is to provide an adornment device which is capable of overcoming the above-described drawbacks of the prior art.

To this end, according to the present invention, there is provided an adornment device comprising: a flexible cord using a plurality of wires as a core and a flexible coating for coating the cord so as to reduce friction from the cord; a retainer having a cord-threading hole through which the cord is inserted once before a clasp and through which the cord is inserted again after being bent; and securing means which, by making use of the characteristics of the flexible coating material, is adapted to secure the cord to the retainer while adjustment of the tension of the cord is being made.

According to another aspect of the present invention, there is provided an adornment device comprising: a flexible cord using a plurality of wires as a core and a flexible coating for coating the cord so as to reduce friction from the cord; a pair of retainers each having a cord-threading hole and bending means for bending the cord inserted through the hole at least once and for allowing the bent cord to protrude from the hole on the outside; securing means which, by making use of the characteristics of the flexible coating material, is adapted to secure end portions of the cord to the pair of retainers, respectively, while adjustment of the tension of the cord is being made; and coupling means for integrally coupling the pair of retainers.

The coupling means is preferably provided with a pair of metallic covers for respectively fitting over the pair of retainers, the pair of covers being connected to each other so as to integrally form the pair of retainers.

Preferably, the pair of retainers are respectively provided with bending portions for bending the cord, the bending portions being provided such as to be accessible from the outside when the pair of retainers are separated from each other.

The diameter of the wire is preferably approximately 0.03 mm.

The coating material is preferably constituted by a vinyl.

The other objects, features and advantages of the present invention will become apparent from the following description of the invention when taken in conjunction with the accompanying drawings.

DESCRIPTION OF THE PREFERRED EMBODIMENTS

Referring now to the accompanying drawings, a detailed description will be given of the preferred embodiments of the present invention.

<Description of First Embodiment>

Figure 1:
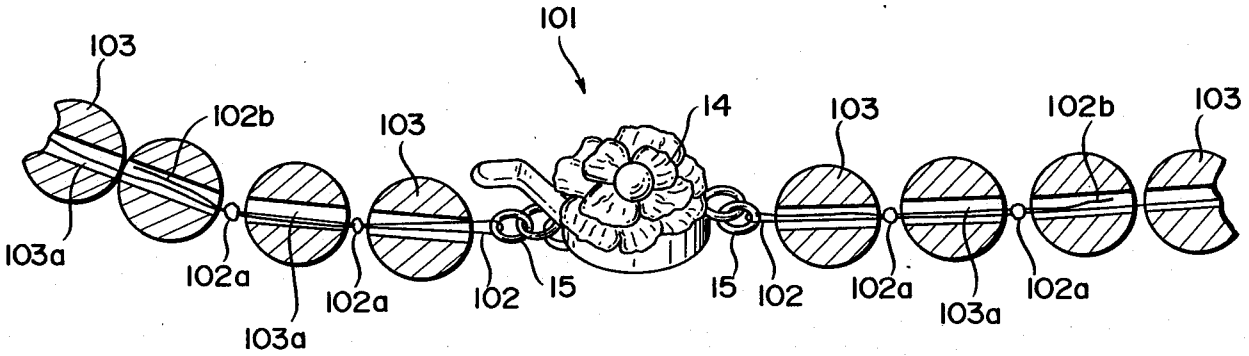
FIG. 1 (PRIOR ART)
FIG. 1 is a perspective view, partly in section, of an adornment device using a silk cord in accordance with a conventional example.
Figure 2:
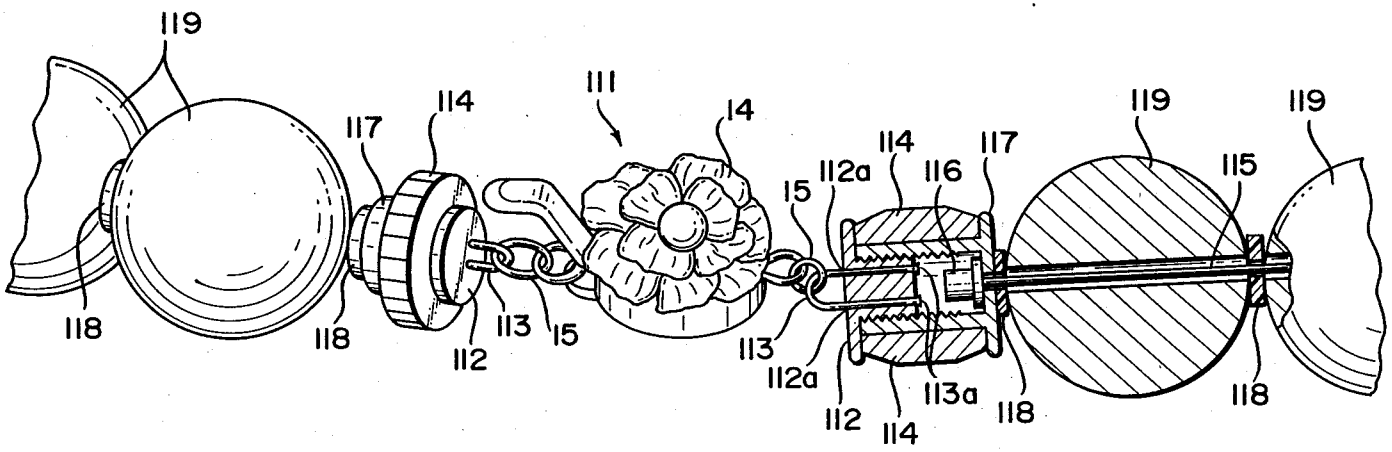
FIG. 2 (PRIOR ART)
FIG. 2 is a perspective view, partly in section, of essential portions of an adornment device in which a welding technique is applied in accordance with another conventional example.
Figure 3:
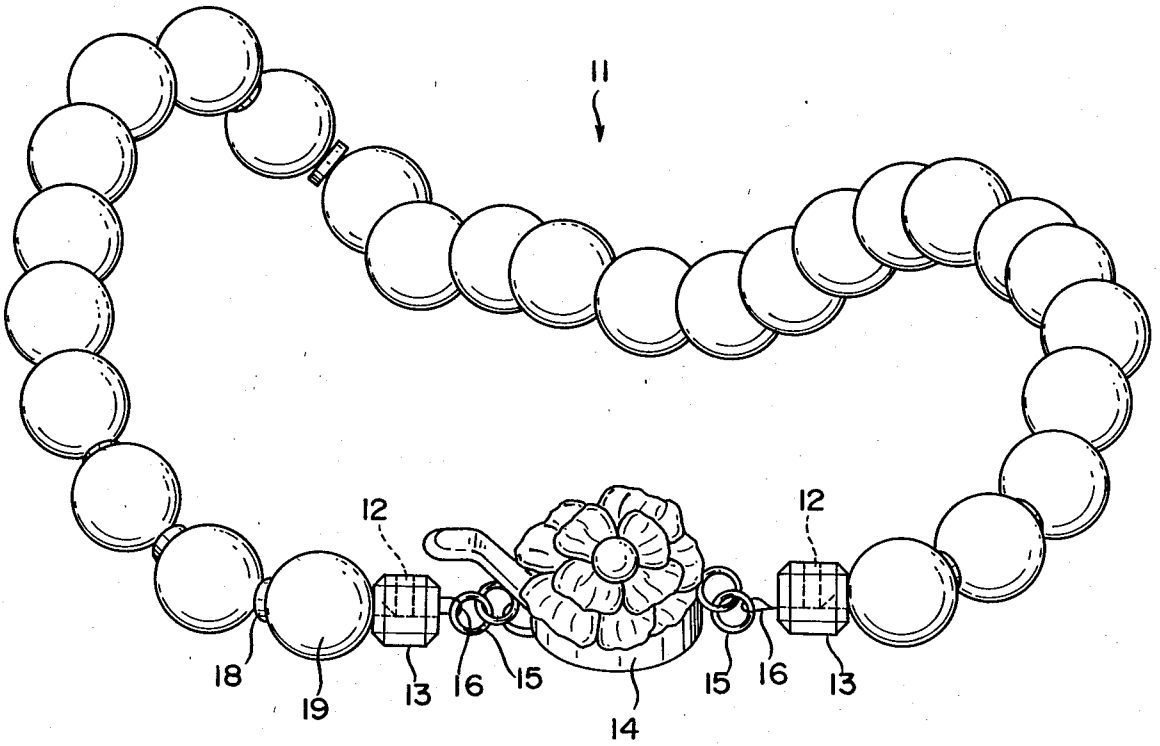
FIG. 3 is a perspective view of the arrangement of an adornment device in accordance with a first embodiment of the present invention.
Figure 4:
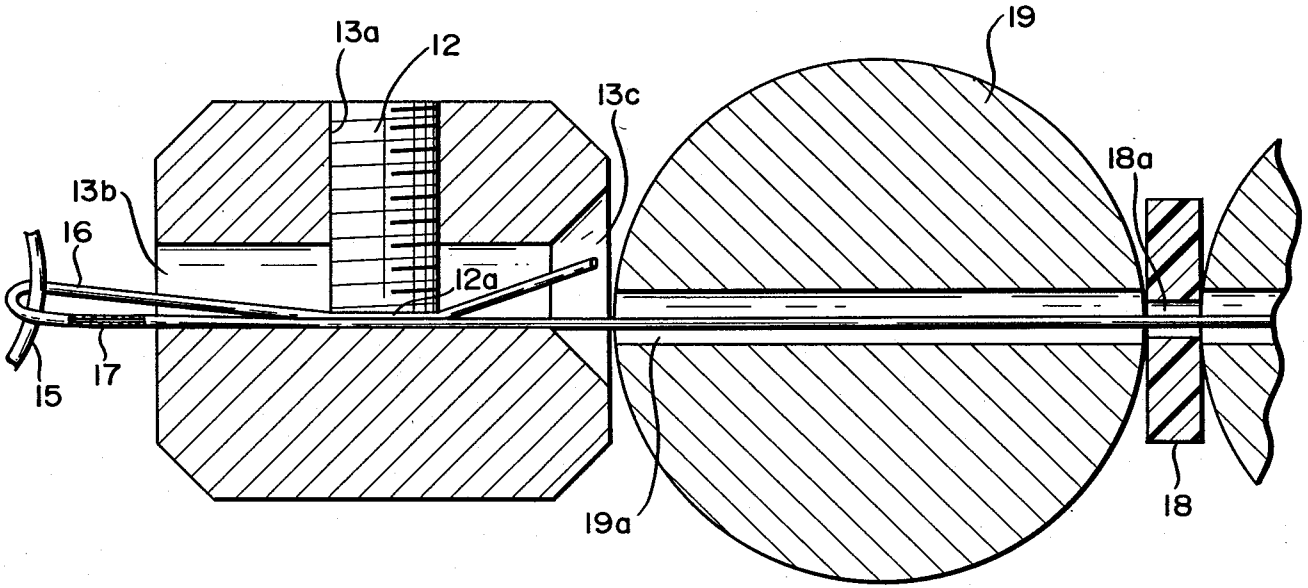
FIG. 4 is an enlarged cross-sectional view of the arrangement of essential portions of the adornment device in accordance with the first embodiment.

FIG. 3 is a perspective view of the arrangement of an adornment device in accordance with a first embodiment of the present invention, while FIG. 4 is a cross-sectional view of essential portions of the adornment device in accordance with the first embodiment.

A description will first be given of the arrangement of the adornment device in accordance with the first embodiment. In FIGS. 3 and 4, reference numeral 11 denotes an adornment device in accordance with the first embodiment, while numeral 16 denotes a stainless steel cord for connecting pieces of an ornament together. This stainless steel cord 16 is formed such that 36 stainless steel wires constituting a core material and each having a diameter of 0.03 mm are bundled, and are coated with vinyl 17 (FIG. 4) in such a manner as to cover the bundle of wires. Thus since the stainless steel cord 16 is a collection of fine wires and is coated with the vinyl 17, the stainless steel cord 16 is capable of exhibiting flexibility which is equivalent to that of a cord formed of fibers or the like.

A clasp 14 has the same arrangement as that of an aforementioned conventional example and is provided with a pair of cord-hooking rings 15, 15 for hooking end portions of the stainless steel cord 16 thereon. Spherical pearls 19 are respectively provided with cord holes **19*a* for inserting the stainless steel cord 16 therethrough. Cylindrically shaped elastic rings 18 are formed of a silicone material and are respectively provided, between pearls thereof, with cord holes 18*a* for inserting the stainless steel cord 16 therethrough. A setscrew 12** is constituted by a threaded portion and is not provided with a head.

In addition, a retainer 13 accommodates the stainless steel cord 16 and detachably retains the same. This retainer 13 has inside thereof a cord hole **13*b* allowing the stainless steel cord 16 to be inserted therethrough and a tapped hole 13*a* which is provided substantially in a central portion thereof such as to be disposed perpendicular to the cord hole 13*b* and is provided with an internal thread so as to be threadingly fitted with a setscrew 12 having a screw end 12*a* positionable in the cord hole 13*b*. The cord hole 13*b* is provided with an opening portion 13*c* which is formed in such a manner as to expand gradually toward one outlet thereof, and has a bore large enough for at least two or more stainless steel cords 16** to be inserted therethrough.

The basic arrangement of the adornment device 11 in accordance with the first embodiment is described above, and a method of assembling the adornment device 11 will now be described with reference to FIG. 5.

Figure 5:
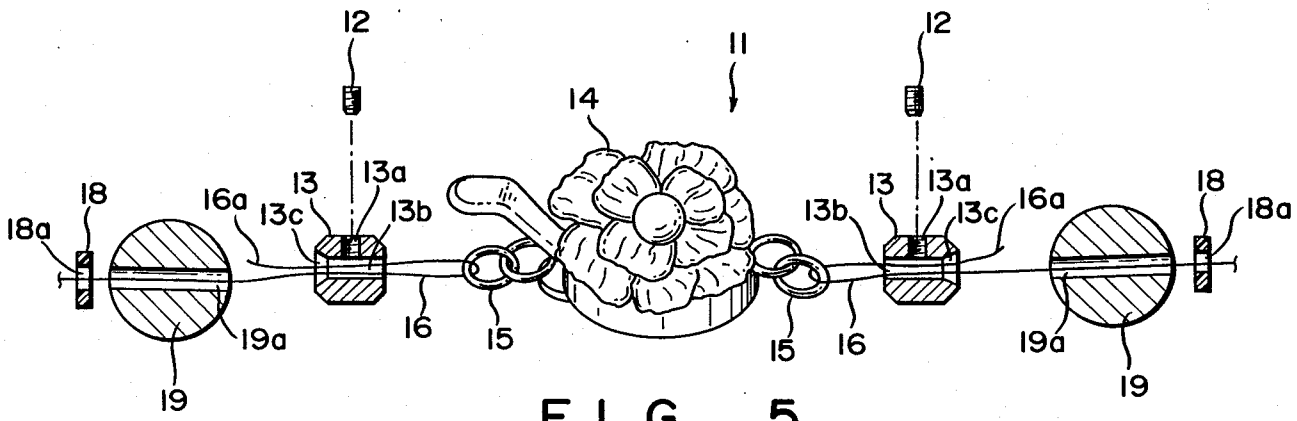
FIG. 5 is a cross-sectional view illustrating a method of assembling the essential portions of an adornment device in accordance with the first embodiment.

FIG. 5 is a cross-sectional view illustrating a method of assembling essential portions of the adornment device 11 in accordance with the first embodiment.

First, the stainless steel cord 16 is inserted into the pearls 19 and the elastic rings 18 alternately in such a manner that each of the elastic rings 18 is interposed between the adjacent pearls 19. Since the elastic ring 18 is interposed between the adjacent pearls 19, the function of protecting the pearls 19 and the function of maintaining the equal distance between the pearls 19 are provided. In addition, since the stainless steel cord 16 is coated with vinyl, this prevents the stainless steel cord 16 from damaging the pearls 19.

In addition, after the stainless steel cord 16 is inserted into a necessary number of the pearls, one end of the stainless steel cord 16 is inserted into the opening portion **13*c* of the first retainer 13 and through the cord hole 13*b*. The stainless steel cord 16 which has come out of the cord hole 13*b* is inserted into the cord-hooking ring 15 provided on the clasp 14 and is doubled back. This doubled-back stainless steel cord 16 is inserted again into the same cord hole 13*b* of the retainer in the opposite direction. Thus the end portion of the stainless steel cord 16 is threaded through the retainer 13** twice.

Next, an appropriate level of tension is imparted to the stainless steel cord 16 at a position at which one end of the doubled-back stainless steel cord 16 protrudes slightly from the cord hole 13*b* of the retainer 13 and can be set as a position for fixing the stainless steel cord 16. In this state, the setscrew 12 is threaded through the tapped hole 13 and the of the retainer 13, a screw end 12*a* of the setscrew 12 is used to press and retain the doubled-back stainless steel cord 16 from above. At this time, since the screw end 12*a* has the function of biting into the vinyl 17 coating the stainless steel cord 16, retention of the cord 16 can be effected favorably.

A surplus cord 16*a* of the stainless steel cord 16 protruding from the opening portion 13*c* of the retainer 13 is then cut off by a cutting tool such as a cutter.

In accordance with the above-described assembling method, the other end of the stainless steel cord 16 is similarly pressed by the setscrew 12 to another retainer 13 so as to be secured by the same means.

Thus, if the stainless steel cord 16 is threaded twice through the respective retainers at the respective end portions thereof, and if the protruding surplus portions of the stainless steel cord 16 are cut off after the stainless steel cord 16 is fixed at positions at which appropriate tension and adjustment in length have been obtained, the operation of assembling the adornment device 11 having the function of a necklace is completed.

In addition, the replacement of the cord can also be carried out simply in a similar procedure and without impairing the beauty of the pearls. When the cord is to be replaced, since the stainless steel cord is retained in a state in which it is pressed by the setscrews, the stainless steel cord can be pulled out simply by loosening the setscrews. Accordingly, when a new stainless steel cord is to be installed, the operation can be effected readily in accordance with the above-described procedure of assembling the adornment device 11.

As has been described above, in accordance with a first embodiment of the present invention, it goes without saying that the adornment can be effected without impairing the inherent attractiveness of the pearls and that the assembly and disassembly can be conducted easily even by laymen.

In addition, since the resilient rings will expand or contract according to the adjustment of the stainless steel cord 16, the interval between pearls can be held relatively constant thus creating a more attractive adornment device.

Furthermore, since a stainless steel cord is used, there is no risk of the cord becoming elongated, and since the stainless steel is coated with vinyl, the stainless steel does not cause damage to the pearls.

<Description of Second Embodiment>

Figure 6A:
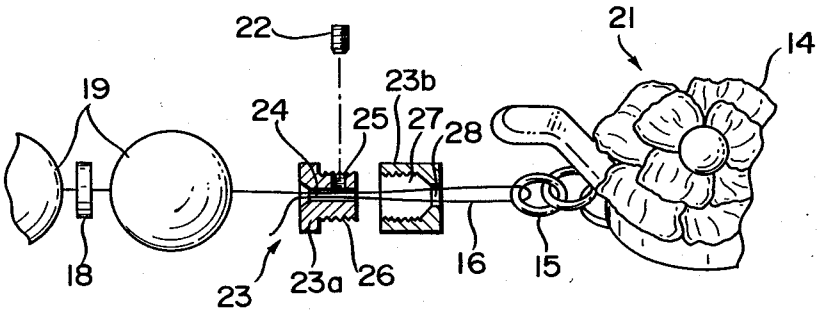
FIGS. 6A to 6C are cross sectional views illustrating a method of assembling the adornment device in accordance with a second embodiment of the present invention.
Figure 6B:
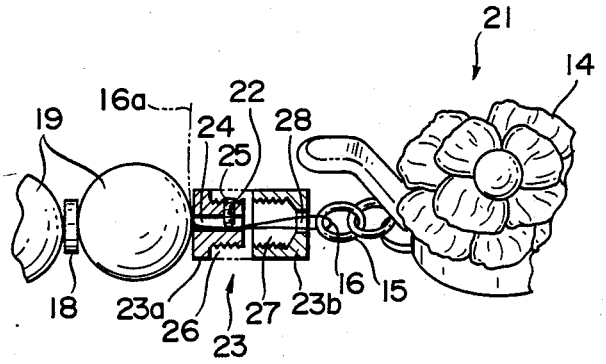
Figure 6C:
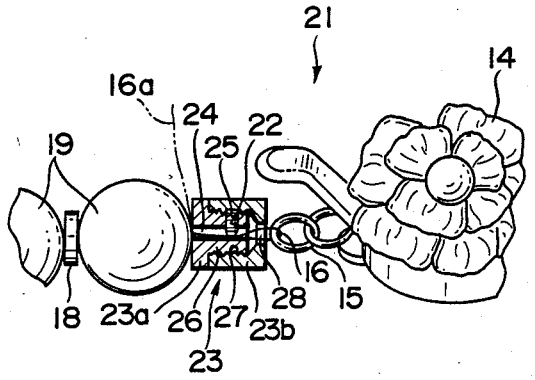

Referring now to FIGS. 6A to 6C, a description will be given of the adornment device in accordance with a second embodiment of the present invention.

FIGS. 6A to 6C are cross-sectional views illustrating a method of assembling essential portions of the adornment device in accordance with the second embodiment.

First, a description will be given of the arrangement of the adornment device in accordance with the second embodiment. In FIGS. 6A to 6C, reference numeral 21 denotes an adornment device in accordance with the second embodiment. Numeral 23 denotes a retainer in which a retainer body 23*a* for performing the function of an external thread and a retainer cover 23*b* for performing the function of an internal thread are made integral. In the same way as the internal configuration of the retainer 13 in accordance with the first embodiment, the retainer body 23*a* is provided with a cord hole 24 having a bore allowing the stainless steel cord 16 to be threaded at least twice therethrough as well as a tapped hole 25 provided perpendicularly of this cord hole 24.

This tapped hole 25 is arranged such that a headless setscrew 22 which is shorter than the tapped hole 25 and is constituted by a threaded portion alone is capable of pressing from above and retaining the stainless steel cord 16 which is inserted twice into the cord hole 24. In addition, the retainer body 23*a* is provided with a threaded portion 26 for engagement with the retainer cover 23*b*. Meanwhile, the retainer cover 23*b* is provided with a threaded portion 27 inside the cover for engagement with the threaded portion 26 of the retainer body 23*a*, and a tapped hole 28 having the same bore as the tapped screw 25 of the retainer body 23.

The basic arrangement of the adornment device 21 in accordance with the second embodiment has been described above, and a method of assembling the adornment device 21 will be described hereafter.

First, when the stainless steel cord 16 is engaged, as shown in FIG. 6A, the cord is inserted into the retainer body 23*a* and the retainer cover 23*b* and into the cord-hooking ring 15 and is then bent and inserted again into the retainer cover 23*b* and the retainer body 23*a*, and the stainless steel cord 16 is adjusted to a suitable length. After this adjustment is over, the stainless steel cord 16 which has been inserted twice through the cord hole 24 of the retainer body 23*a* and the cord hole 28 of the retainer cover 23*b* is pressed and retained by means of the setscrew 22. Namely, the stainless steel cord 16 is secured by this pressing.

It goes without saying that since the fixing of the cord involves only a simple operation of tightening the screw 22, it is not troublesome.

FIG. 6B shows a state in which the stainless steel cord 16 is retained. The retainer cover 23*b* is made integral with the retainer body 23*a* in order to prevent the tapped hole 25 provided in the retainer body 23*a* from becoming exposed. The surplus cord 16*a* protruding from the retainer body 23*a* is then cut off.

FIG. 6C illustrates the above-described integrated state. If the cover is provided for the retainer body so that the setscrew 22 will not be seen, the effect of further enhancing the inherent beauty and attractiveness of the pearls 19 can be accomplished.

As described above, although, in the first and second embodiments, stainless steel is used as the material of the cord, the present invention is not restricted to the same, and a wire of another metallic material may be used insofar as it does not deviate from the purpose of the present invention. In addition, when the stainless steel cord is used, the diameter of one wire and the number of the wires to be bundled are not restricted if an effect similar to those obtained in the above-described embodiments can be produced.

Furthermore, although a pair of retainers are used in the first and second embodiments, an arrangement may be alternatively provided such that the opposite ends of the cord are retained by a single retainer.

<Description of Third Embodiment>

Accordingly, with reference to FIGS. 7 and 8A to 8E, a description will now be given of an adornment device in which pearls are connected together into the form of a chain by means of a single retainer without using the clasp.

Figure 7:
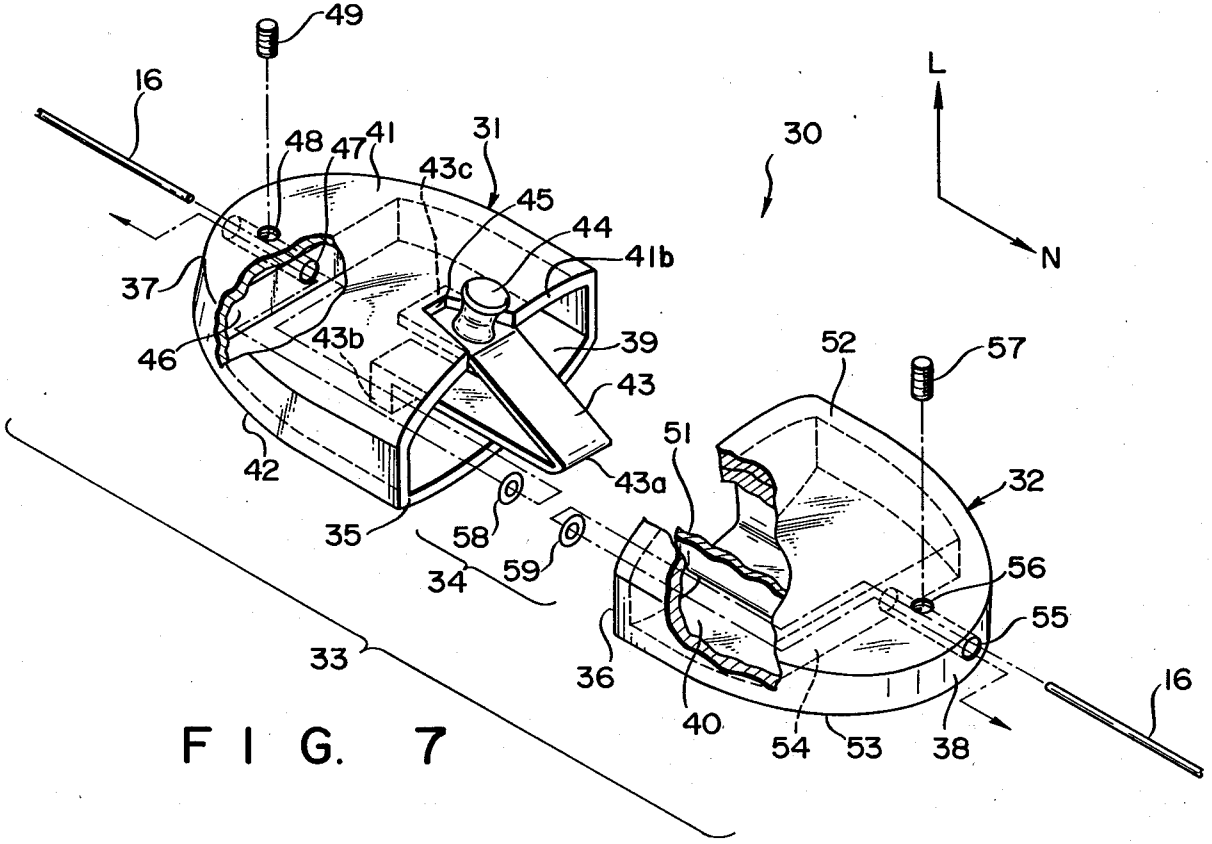
FIG. 7 is an enlarged exploded perspective view of the arrangement of essential portions of the adornment device in accordance with a third embodiment of the present invention.

FIG. 7 is an enlarged exploded view of essential portions of an adornment device in accordance with a third embodiment of the present invention, while FIGS. 8A to 8E are cross-sectional views illustrating a method of assembling the essential portions of the adornment device in accordance with the third embodiment.

Incidentally, the stainless steel 16 is used as the cord for connecting the pearls together in the same way as the first and second embodiments. The pearls connected by this stainless steel cord 16 are not illustrated.

First, the arrangement of the third embodiment will be described.

In FIG. 7, reference numeral 30 denotes an adornment device in accordance with the third embodiment. This adornment device 30 comprises the stainless steel cord 16 and a retainer body 33 in which a retainer male portion (hereafter referred to as the "male portion") 31 and a retainer female portion (hereafter referred to as the "female portion") 32 which are respectively adapted to retain and secure the end portions of the cord are combined together and made integral. This retainer body 33 in the integrated state has the size of an ordinary pendant, and a cross-sectional configuration thereof in the direction of the arrow L has a substantially oval shape.

In addition, a coupling portion 34 for coupling the male portion 31 and the female portion 32 has an arrangement in which the retainer body 33 is separated by a slant surface, which is inclined counterclockwise from a direction perpendicular to the longitudinal direction of the retainer body 33, into two bodies in the vicinity of a central portion thereof. The male portion 31 and the female portion 32 obtained by splitting the retainer body 33 into two has substantially symmetrical configurations with the coupling portion as a boundary.

In addition, the cross-sectional configuration of the retainer body 33 taken in the direction of the arrow N is substantially quadrilateral, and the opposing two long sides are respectively provided with rounded portions in such a manner as to depict arcs toward the outside, respectively. The male portion 31 and the female portion 32 are provided with respective coupling surfaces 35, 36 which constitute the coupling portion 34 and are provided with openings. The male portion 31 and the female portion 32 are formed in such a manner that two-thirds of the region up to respective rear portions 37, 38 are made hollow. A coupling mechanism for coupling the male portion 31 and the female portion 32 is disposed in respective hollow portions 39, 40.

In the hollow portion 39 of the male portion 31, opposite end portions of a leaf spring 43 bent with a chevron-shaped cross section are held between an inner surface **41*a* of an upper plate 41 of the male portion 31 and an inner surface 42*a* of a bottom plate 42 thereof, and a bent portion 43*a* of the bent leaf spring 43 projects outwardly. As a method of installing this leaf spring 43, one end 43*b* of the leaf spring 43 is secured to a substantially central portion of the inner surface 42*a* of the bottom plate 42** by means of brazing.

Meanwhile, the other spring end **43*c* which constitutes a free end is provided with an upwardly projecting button 44 to allow the same to be pressed manually so as to operate the expansion and shrinkage of the leaf spring 43, and the transverse width of the button 44 is set such as to be smaller than that of the leaf spring 43. In addition, a notch 45 formed to such an extent that allows the button 44 provided on the other end 43*b* to project therefrom is provided at an upper plate edge portion 41*b* on the side of the coupling surface 35**.

In addition, in the hollow portion 39, a cord hole 47 which penetrates up to the rear portion 37 is provided in a substantially central portion of a bottom surface 46 constituting a bottom of the hollow portion 39. A tapped hole 48 penetrating vertically from the top of the upper plate 41 toward the cord hole 47 is provided in a substantially central portion of the cord hole 47 in the direction of the arrow N. A headless setscrew 49 is threaded through the taped hole 48 so as to press from above the stainless steel cord 16 which is inserted twice into the cord hole 47. The size of the diameter of the cord hole 47 and the configuration of the setscrew 49 for threading through the tapped hole 48 are similar to those of the above-described first and second embodiments.

Meanwhile, in the hollow portion 40 of the female portion 32, if the female portion 32 is made to approach the male portion 31 with the compressed state of the leaf spring 43 being maintained, the compressed leaf spring 43 is adapted to be fitted into a recess 51 formed in the hollow portion 40 of the female portion 32. The recess 51 is secured to the upper plate 52 and bottom plate 53 of the female portion 32, and is provided with a sufficient depth for receiving the projection of the leaf spring 43 in the direction of the arrow N.

When the fitted leaf spring 43 is lifted up by its own spring force when the compressive force of the leaf spring 43 is released with the leaf spring 43 being fitted completely in the recess 51. The leaf spring 43 is then frictionally engaged with an upper portion of the inner surface of the recess 51. The male portion 31 and the female portion 32 are thus coupled with each other.

In addition, in the same way as the male portion 31, the female portion 32 is also provided with a cord hole 55 in such a manner as to penetrate the bottom surface 54 of the hollow portion 40 up to the rear portion 38. A tapped hole 56 is provided from the upper plate 52 perpendicularly to the cord hole 55. A headless setscrew 57 is threaded through this tapped hole 56 and presses from above the stainless steel cord 16 which is inserted twice into the cord hole 55. The size of the diameter of the cord hole 55 and the configuration of the setscrew 57 for threading through the tapped hole 56 are similar to those of the above-described first and second embodiments.

In addition, when the stainless steel cord 16 is to be retained by the male portion 31, one end of the stainless steel cord 16 is inserted from the rear end 37 side to the bottom surface 46 side, is made to protrude from the hollow portion 39 to the outside, and is inserted once into a metallic ring 58 having an outer diameter greater than the bore of the cord hole 47. The stainless steel cord 16 is then doubled back toward the hollow portion 39, and is inserted into the cord hole 47 from the bottom surface 46 side toward the rear portion 37 side. In this state, if the bent end portion of the stainless steel cord 16 is held in such a manner that it will not move and if the other end is pulled, the ring 58 which constitutes a bending portion is stopped at an opening portion of the cord hole 47 to function in such a manner that the stainless steel cord 16 will not come out the cord hole 47. Namely, the bottom surface 46 of the hollow portion 39 and the ring 58 function as a retainer of the stainless steel cord 16.

Furthermore, when the stainless steel cord 16 is to be retained by the female portion 32, a method is used in which the other end of the stainless steel cord 16 is inserted once through a ring 59 in the same way as the male portion 31.

Referring now to FIGS. 8A to 8E, a description will be given of a method of assembling the adornment device 30 thus constructed.

Figure 8A:
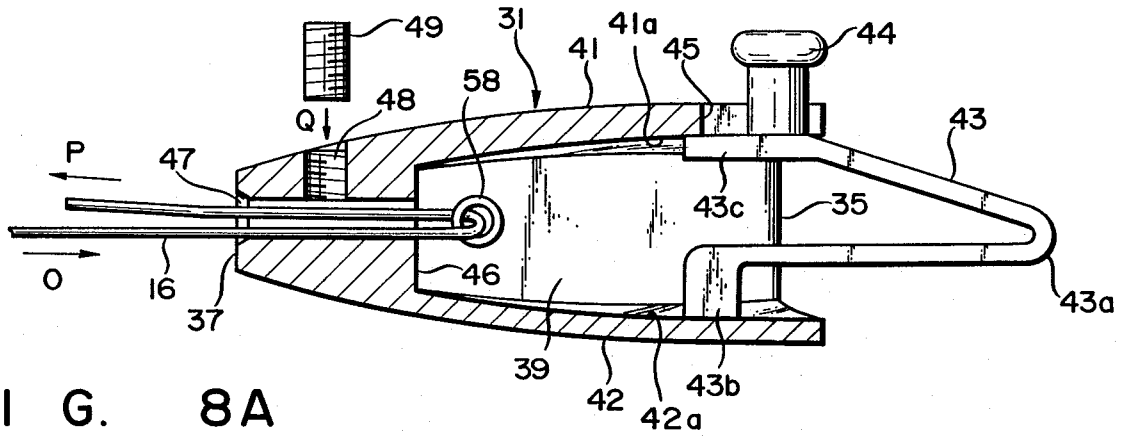
FIGS. 8A to 8E are cross-sectional views illustrating a method of assembling essential portions of the adornment device in accordance with the third embodiment.
Figure 8B:
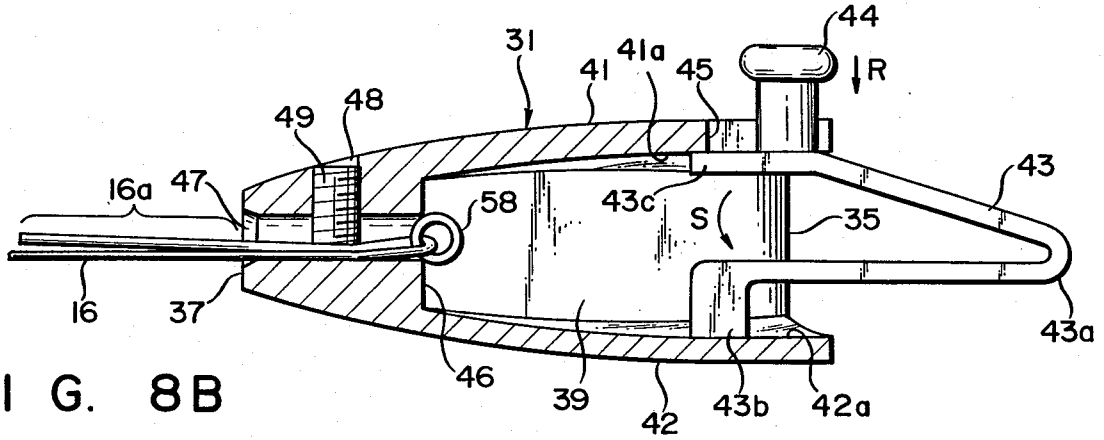
Figure 8C:
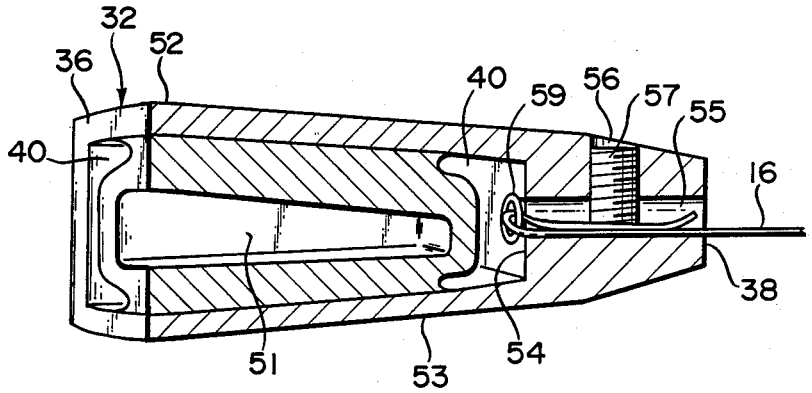

In the male portion 31, as illustrated in FIGS. 8A and 8C, one end of the stainless steel cord 16 is inserted from the rear end 37 side into the cord hole 47 in the direction shown by the arrow 0 up to the bottom surface 46, and is once made to protrude from the hollow portion 39 to the outside. Consequently, the bent cord can be accessed from the outside. In other words, after the tip of the cord is inserted once into the ring 58 and is then bent, and is made to protrude slightly from the bottom surface 46 side of the cord hole 47 along the direction shown by the arrow P. Thus adjustment of the tension of the stainless steel 16 is made, but, in this case, both of the doubled-back portions of the stainless steel cord 16 are pulled in the direction indicated by the arrow P, and a state in which the ring 58 abuts against the cord hole 47 is maintained. Subsequently, while the setscrew 49 is being inserted into the tapped hole 48 in the upper plate 41, the stainless steel cord 16 placed in the cord hole 47 in a bent state is pressed by the setscrew 49. When the stainless steel cord 16 is retained in such a manner that one end thereof is not removed, the surplus cord **16*a*** is cut.

In addition, with respect to the female portion 32 as well, the other end of the stainless steel cord 16 is retained in the same manner as in the case of the male portion 31. When the stainless steel cord 16 is to be retained by the female portion 32, it goes without saying that the cord has been already been threaded through the pearls, and the length of the stainless steel cord 16 formed into an annular shape is also adjusted at that time.

Figure 8D:
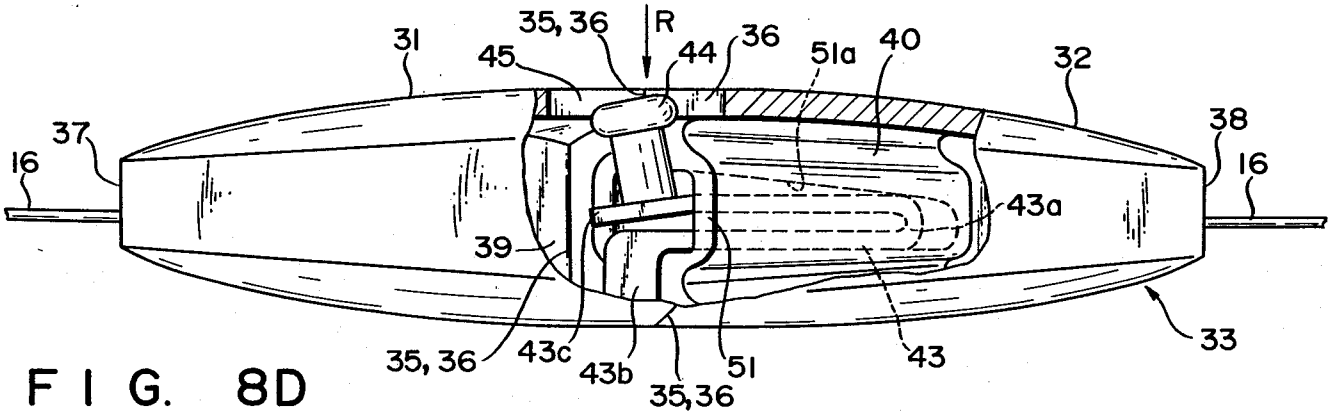
Figure 8E:
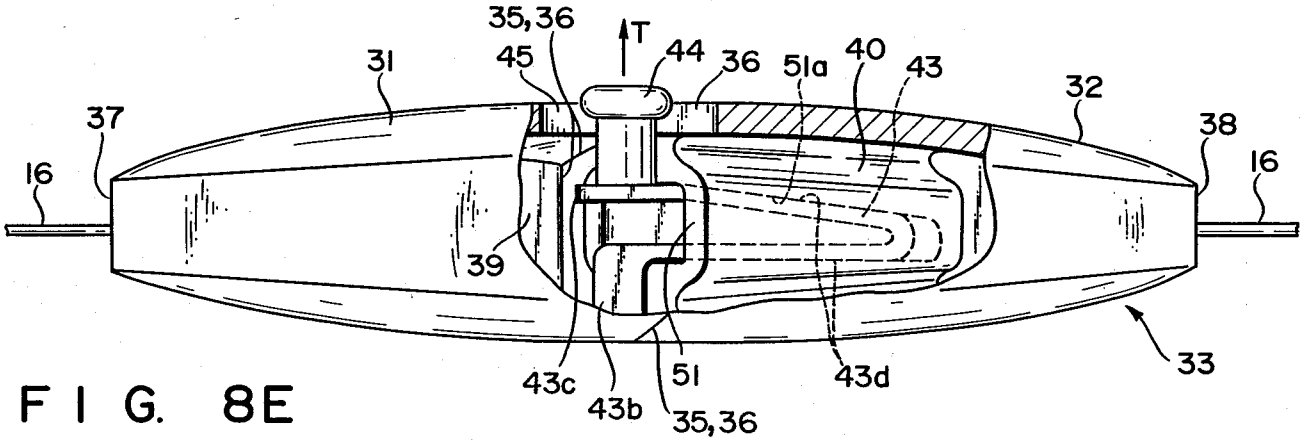

After the end portions of the stainless steel cord 16 are thus retained at the male portion 31 and the female portion 32, respectively, the button 44 in the male portion 31 is first pressed in the direction of the arrow R to compress the leaf spring 43 in the direction shown by the arrow S, in order to couple the male portion 31 with the female portion 32. While this state is being maintained, the tip portion of the leaf spring 43 is fitted with the recess 51 of the female portion 32, as shown in FIG. 8D. At this time, the amount of compression of the leaf spring 43 is set such as to be narrower than the width of the opening of the recess 51.

When the coupling surfaces 35, 36 are brought into contact with each other, if the pressing force acting on the button 44 is released, the button 44 tends to move in the direction of the arrow T by virtue of its own spring force. At this time, an outer surface **43*d* of the leaf spring 43 frictionally engages with an inner surface 51*a* of the recess 51 which serves as a fitting portion, so that the male portion 31 and the female portion 32** are coupled with each other, and the coupled state is maintained.

As described above, in accordance with a third embodiment of the present invention, it is possible even for laymen to connect a cord threaded through pieces of an ornament consisting of pearls or the like, by means of a simple arrangement using a single retainer. In addition, the same operation and effect as described in the first and second embodiments can be obtained.

<Description of Fourth Embodiment>

Figure 9:
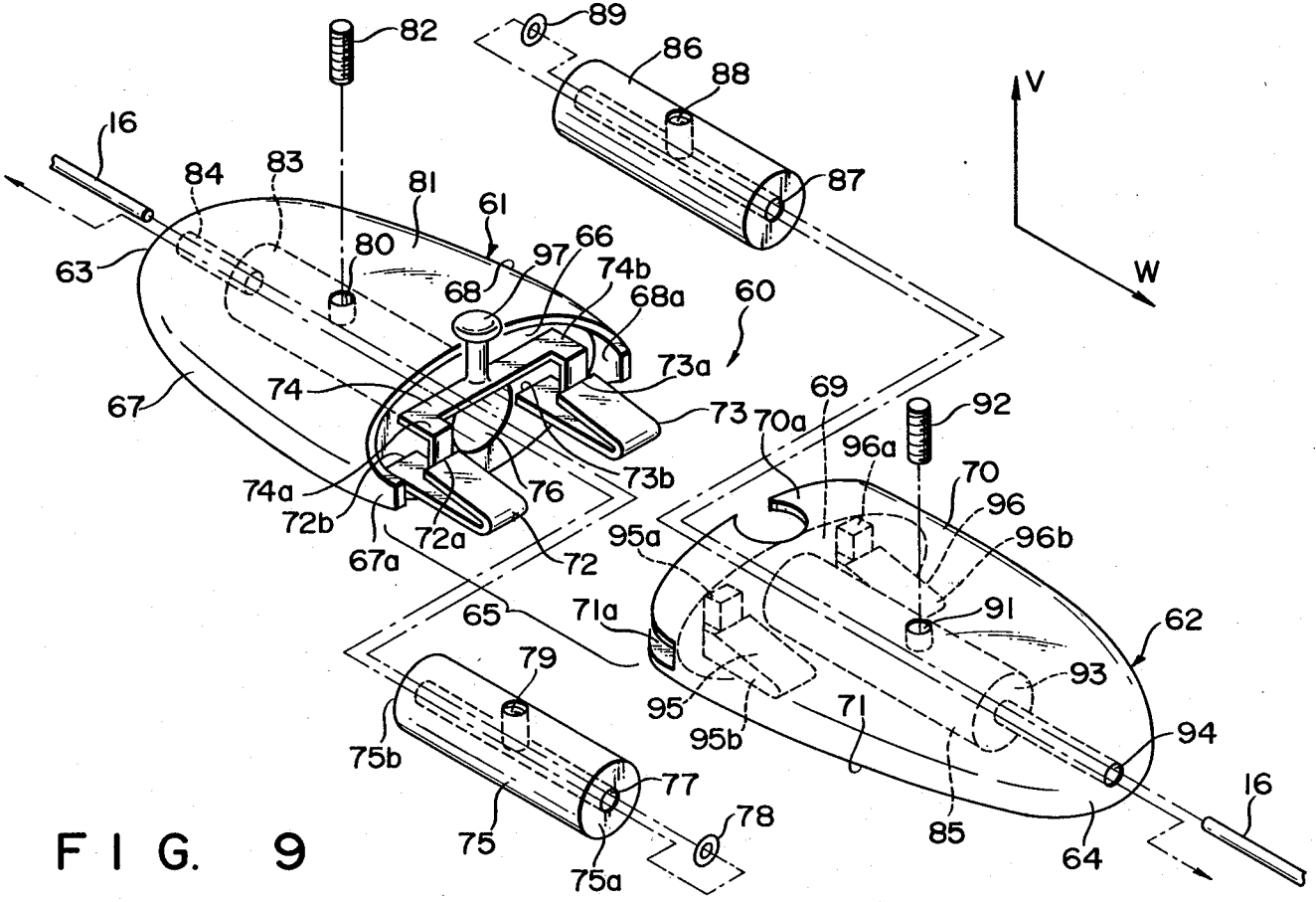
FIG. 9 is an enlarged exploded perspective view of the arrangement of essential portions of the adornment device in accordance with a fourth embodiment of the present invention.

Referring now to FIG. 9, a description will be given of a fourth embodiment in which the third embodiment is applied.

First, in the fourth embodiment, in order to favorably maintain the coupling state of the retainer body used in the third embodiment, a retaining mechanism for retaining the cord is provided in the retainer, and a pair of retainers are integrated by means of retainer covers for covering the retainers.

FIG. 9 is an enlarged exploded view of the arrangement of essential portions of an adornment device in accordance with the fourth embodiment. In the drawing, reference numeral 60 denotes an adornment device in accordance with the fourth embodiment. In this adornment device 60, reference numeral 61 denotes a retainer male cover portion (hereafter referred to as the "male cover portion"), while numeral 62 denotes a retainer female cover portion (hereafter referred to as the "female cover portion").

Cross sections of the male cover portion 61 and the female cover portion 62 taken in the direction of the arrow W are formed substantially into an oval shape, and have expanded portions expanding from rear portions 63, 64, respectively, toward a coupling portion 65. A coupling surface 66 of the male cover portion 61 in the coupling portion 65 is arranged such that side walls 67, 68 project in the direction of the arrow W by identical amounts and are respectively provided with tapered projections **67*a*, 68*a* in such a manner that tips thereof are slightly tapered off. Meanwhile, a coupling surface 69 of the female cover portion 62 is arranged such that tongue portions 70*a*, 71*a* are provided such as to project from an upper wall 70 and a bottom wall 71, respectively, in the form of a tongue in the direction of the arrow W, so as to be able to engage with the configuration of the aforementioned coupling surface 66. Consequently, when the male cover portion 61 and the female cover portion 62 are coupled with each other, the coupling surface 69 of the female cover portion 62 is capable of engaging with the configuration of the projections 67*a*, 68*a***.

In addition, the coupling surface 66 is also provided with a leaf spring mechanism having an arrangement which is similar to the leaf spring 43 of the male portion 31 described in the third embodiment. In the fourth embodiment, two leaf springs 72, 73 are used, a button 97 erected in the direction of the arrow V on a substantially central portion of a connecting portion 74 connecting respective ends **72*a*, 73*a* are provided as a free ends. Meanwhile, both of other ends 72*b*, 73*b* are secured to the coupling surface 66. The leaf springs 72 and 73 are located such as to be spaced away with an interval which is greater than the bore of a fitting hole 76 provided to allow a cylindrical cord retainer 75, which will be described later, to be fitted thereinto. In addition, this fitting hole 76 does not penetrate up to the rear end 63, and its depth is made slightly longer than the longitudinal length of the cord retainer 75**.

In particular, the connecting portion 74 includes integrally connecting parts **74*a*, 74*b* at both ends thereof, projecting from the front surface thereof along the arrow W and distal ends being bent downward. The lower ends of the connecting parts 74*a*, 74*b* are connected to the upper surface of respective leaf springs 72, 73**.

The cord retainer 75 has respective ends 75*a* and 75*b* a cord hole 77 axially penetrating the same. This cord hole 77 is sufficiently large to allow the stainless steel cord 16 to be inserted therethrough once and to be threaded therethrough again after being threaded through a metallic ring 78. Incidentally, the inside diameter of the ring 78 is set such as to be greater than the diameter of the cord hole 77 as in the case of the above-described third embodiment.

A tapped hole 79 is provided in a substantially central portion of the cord retainer 75 substantially perpendicularly to the cord hole 77 such as to communicate therewith. A hole 80, which aligns with the tapped hole 79 when the cord retainer 75 is fitted into the fitting hole 76 with the tapped hole 79 facing upward, i.e., in the direction of the arrow V, is provided in an upper wall 81 of the male cover portion 61. This hole 80 is not provided with threads, and serves as a guide for guiding into the tapped hole 79 a headless setscrew 82 having the same arrangement as that of the setscrew used in the above-described third embodiment.

Namely, the arrangement is such that the setscrew 82 can be threaded through upon reaching the tapped hole 79 after the setscrew 82 is inserted into the hole 80.

In addition, a cord hole 84 which aligns with the cord hole 77 of the cord retainer 75 is provided at an innermost end surface 83 of the fitting hole 76 in such a manner as to penetrate up to the rear portion 63. The bore of this cord hole 84 is set such as to be substantially equivalent to that of the cord hole 77.

Furthermore, in the same way as the male cover portion 61, a fitting hole 85 of an identical configuration is provided in the female cover portion 62 as well in such a manner as not to penetrate the same in the direction of the arrow W. A cord retainer 86 having substantially the same dimensions as the aforementioned cord retainer 75 is fitted into this fitting hole 85. This cord retainer 86 is provided with a cord hole 87 and a tapped hole 88 in positional relationships similar to those of the cord hole 77 and the tapped hole 79 mentioned above. The cord hole 87 has a bore sufficiently large to allow the stainless steel cord 16 to be threaded once therethrough and to be threaded therethrough again after it is inserted into a ring 89 having the same configuration as the aforementioned ring 78 and is bent after it has appeared on the opposite side of the hole.

A hole 91, which aligns with the tapped hole 88 when the cord retainer 86 is fitted into the fitting hole 85 in the same way as the aforementioned male cover portion 61, is provided in the upper wall 70 of the female cover portion 62. A setscrew 92 having the same configuration as the setscrew 82 is inserted into this hole 91, and can be threadingly fitted after reaching the tapped hole 88.

In addition, a cord hole 94, which aligns with the cord hole 87 of the cord retainer 86, is provided at an innermost end surface 93 of the fitting hole 85 in such a manner as to penetrate the same up to the rear portion 64. The bore of this cord hole 94 is set to be substantially identical with that of the cord hole 87.

In addition, if the pair of leaf springs 72, 73 provided on the coupling surface 68 of the male cover portion 61 are compressed in the opposite direction to the direction of the arrow V, and if the male cover portion 61 is made to approach a coupling surface 69 of the female cover portion 62 while this state is being maintained, the compressed leaf springs 72, 73 are adapted to be fitted into a pair of recesses 95, 96 provided in such a manner as to be located on both sides of the fitting hole 84 of the female cover portion 62. The recesses 95, 96 respectively have cross sections shaped like the inverted T in the direction of the arrow W. Connecting parts 74*a*, 74*b* of the connecting portion 74 are respectively inserted into recesses 95*a*, 96*a* extending in the direction of the arrow V in the recesses 95, 96, while the leaf springs 72, 73 are inserted into recesses 95*b*, 96*b* that are substantially perpendicular to the recesses 95*a*, 96*a*. Thus, if the compressive forces acting on the respective leaf springs are released with the connecting parts 74*a*, 74*b* and the leaf springs 72, 73 being completely accommodated in the recesses 95, 96, the leaf springs 72, 73 are lifted up by virture of their own spring forces and are frictionally engaged with upper surfaces of the respective recesses 95, 96. In addition, the male cover portion 61 and the female cover portion 62 are thus coupled with each other without being spaced apart from each other, and this coupled state is maintained.

Next, a description will be given of a method of assembling the adornment device 60 thus constructed, with reference to FIGS. 10A to 10C.

Figure 10A:
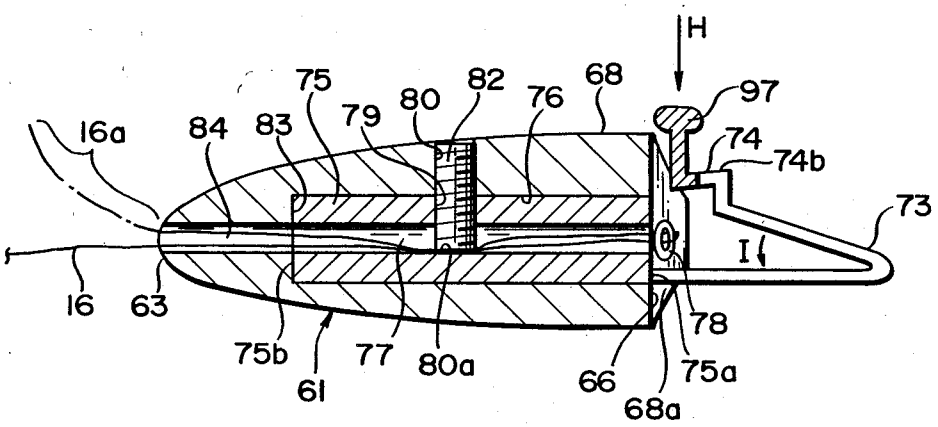
FIGS. 10A to 10C are cross-sectional views illustrating a process of assembling the adornment device in accordance with the fourth embodiment.
Figure 10B:
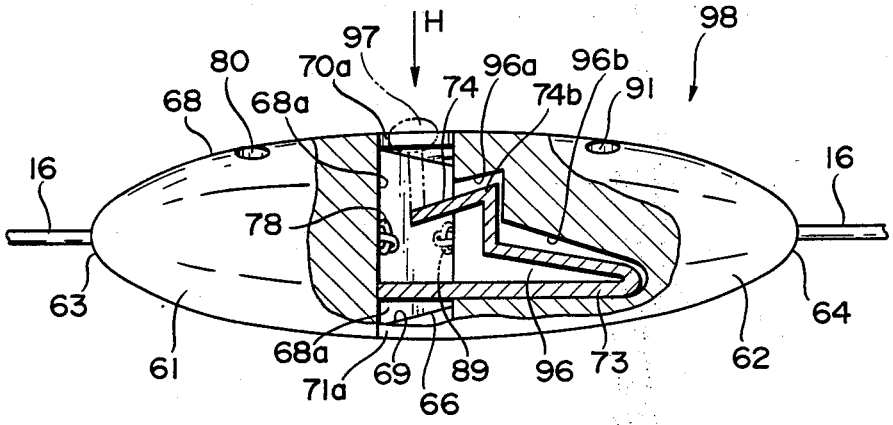
Figure 10C:
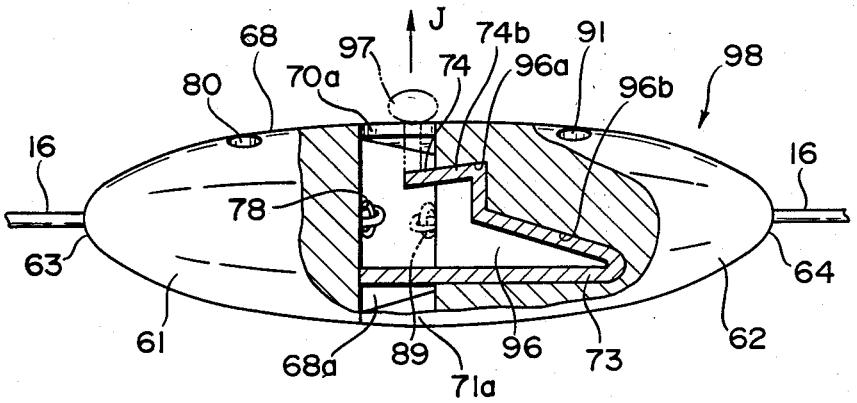

FIGS. 10A to 10C are cross-sectional views illustrating a process of assembling the adornment device 60 in accordance with the fourth embodiment.

When the cord retainer 75 is to be fitted with the male cover portion 61, one end of the stainless steel cord 16 is first inserted through the male cover portion 61 from the rear portion 63 thereof and through the fitting hole 76 as well, and is led to the outside. Furthermore, the tip portion of the cord is inserted through the cord hole 77 of the cord retainer 75 and through the ring 78 after it has come out of the hole, and the tip portion of the cord is reinserted through the cord hole 77. Subsequently, the tip portion of the cord 16 is reinserted through the cord hole 84 through which the stainless steel cord 16 has been threaded once. At this juncture, two pieces of the stailess steel cord 16 project from the cord hole 84.

Subsequently, the two pieces of the stainless steel cord 16 protruding from the cord hole 84 are pulled until appropriate tension is obtained, and the ring 78 is pulled by the stainless steel cord 16 and is brought into contact with one opening surface 75*a* of the the cord hole 77. While this state is being maintained, the cord retainer 75 is threaded through the fitting hole 76, beginning at the other opening surface 75*b* of the cord hole 77. In this case, the tapped hole 79 is made to face the direction of the arrow V so that the hole 80 and the tapped hole 79 will align with each other.

Thus, the cord retainer 75 is fitted into the male cover portion 61, and the tension of the stainless steel cord 16 is finally adjusted. Subsequently, the setscrew 82 is inserted into the hole 80, and a screw end 80*a* is made to press the stainless steel cord 16 to secure the same, as shown in FIG. 10A. Hence, one end of the stainless steel cord 16 is secured. At this juncture, the surplus cord 16*a* is cut off by a cutting tool. Incidentally, the cord retainer 75 is secured to the male cover portion 61 by means of a securing method such as brazing so as to prevent it from coming off.

In addition, the other end portion of the stainless steel cord 16 is also secured in accordance with a process similar to the one in which the cord retainer 75 is fitted into the male cover 61 to secure the end portion of the stainless steel cord 16.

Subsequently, the male cover portion 61 and the female cover portion 62, to which the respective end portions of the stainless steel cord 16 have been secured, are coupled with each other.

As shown in FIG. 10A, the button 97 is depressed in the direction of the arrow H to compress the leaf springs 72 (not shown since the drawing is a cross-sectional view) and 73 of the connecting portion 74 substantially simultaneously. While maintaining the state in which the leaf springs 72, 73 are compressed in the direction of the arrow H, the leaf springs 72, 73 and the connecting parts 74*a*, 74*b* are inserted into the recesses 95, 96 of the female cover portion 62. When the respective coupling surfaces 66, 69 are coupled with each other, the force acting downwardly in the direction of the arrow H is released. As a result, by virtue of the spring forces, the recesses 95, 96 are frictionally engaged with the leaf springs 72, 73 and the upper surfaces of the connecting parts 74*a*, 74*b*. The male cover portion 61 and the female cover portion 62 are thus completely coupled with each other, and this coupling state is maintained. At this juncture, the button 97 projects upwardly slightly above the respective upper walls.

The male cover portion 61 and the female cover portion 62 are thus coupled with each other so as to form an integrated retainer 98. In accordance with the fourth embodiment, the two leaf springs that are provided in the male cover portion 61 further strengthen the coupling between the male cover portion 61 and the female cover portion 62. In addition, since recesses and projections are provided in the coupling portions between the male cover portion and the female cover portion, the positioning of the respective coupling portions is facilitated, and this arrangement also serves to prevent offset. Furthermore, the retainer 98 can be simply separated into the male cover portion 61 and the female cover portion 62 by depressing of the slightly projecting button 97 to lessen the engaging forces acting between the recesses and the leaf springs.

Incidentally, a description of the process of connecting pearls into the form of a chain will be omitted, since it is similar to that described in the first embodiment.

In addition, with respect to the operation and effect of the adornment device using the stainless steel cord 16 and the single retainer without using the clasp, it is possible to obtain the same operation and effect as those described in the first to third embodiments.

In the first to fourth embodiments, if the cord is hooked on the ring, the cord can be bent, so that only one cord hole need be used. This arrangement extremely simplifies the arrangement of the retainer.

Although, in the first to fourth embodiments, the configuration of the retainer is made planar, the present invention is not restricted to that configuration, and the retainer may be provided with a tubular shape or quadrilateral configuration insofar as the beauty of the adornment device is not hampered.

In addition, although in the third and fourth embodiments a method of integrally forming a retainer by making use of the spring forces of the leaf springs is employed, the present invention is not restricted to the same, and an arrangement may alternatively be provided such that connecting portions for connecting a male portion (including a male cover portion) and a female portion (including a female cover portion) are thread coupled with each other. In this case, no leaf spring may be used, and an extremely simplified arrangement can be provided. In addition, when a leaf spring is used, it suffices if a projection is provided on an external surface of a leaf spring disposed in the male portion, and a groove for engagement with this projection for frictional engagement therebetween is provided at an inner surface of a recess provided in the female portion. This arrangement increases a coupling force.

Moreover, means of bending the cord is not necessarily confined to a ring, and a column may be provided in a hollow portion or string hole of the retainer in such an manner that the cord will not come off.

As has been described above, in accordance with the present invention, since a cord formed of wires is coated with a flexible coating material, it is possible to provide an adornment device which is provided with flexibility similar to that of silk yarn, and whose cord will not stretch to its full length. Moreover, since the operation is completed by inserting the cord twice into the retainer and fixing the cord after an appropriate tension is obtained, no special mechanical device is required in preparing an adornment device.

In addition, since a cord-bending mechanism is provided in a retainer using a clasp, it is possible to provide an adornment device which is capable of simplifying the overall arrangement of the device and which can be readily assembled by coupling a pair of retainers to which the ends of a cord are secured. Moreover, it is possible to provide an adornment device which is capable of coupling a pair of retainers very positively since a connecting arrangement for a retainer is provdied separately from a mechanism of retaining the cord. Furthermore, since the bent cord can be accessed from the outisde, the insertion of the cord into the hole is facilitated significantly.

The many features and advantages of the present invention are apparent from the detailed specification, and thus, it is intended by the appended claims to cover all such features and advantages of the device which fall within the true spirit and scope of the invention. Further, since numerous modifications and changes will readily occur to those skilled in the art, it is not desired to limit the invention to the exact construction and operation illustrated and described. Accordingly, all suitable modifications and equivalents may be resorted to falling within the scope and spirit of the invention.

What is claimed is:

1. An adornment device comprising:

a flexible cord having a plurality of thin wires as a core and an outer cord coating for covering said plurality of thin wires, the outer coating being formed of a flexible, soft-resilient material so as to reduce frictional contact from the cord and to enhance securing of the cord;

a retainer having a cord-threading hole through which said cord is inserted once before a clasp and through which said cord is looped back after being bent at a bending point; and a releasable securing means for engaging the outer cord coating, said cord being securable at said retainer by said securing means while adjustment of the tension of said cord is being made.

2. An adornment device according to claim 1, wherein the diameter of said wire is approximately 0.03 mm.

3. An adornment device according to claim 1, wherein said coating material comprises a vinyl.

4. An adornment device comprising:

a flexible cord having a plurality of thin wires as a core and an outer cord coating for covering said plurality of thin wires, the outer coating being formed of a flexible, soft-resilient material so as to reduce frictional contact from the cord and to enhance securing of the cord;

a pair of retainers, each retainer having a cord-threading hole through which an end portion of said cord is inserted at least once and for looping back said cord after being bent at a bending point to protrude from said hole on the outside;

a releasable securing means for engaging the outer cord coating, said end portions of said cord being securable to said pair of retainers, respectively, while adjustment of the tension of said cord is being made; and coupling means for integrally coupling said pair of retainers.

5. An adornment device according to claim 4, wherein the diameter of said wire is approximately 0.03 mm.

6. An adornment device according to claim 4, wherein said coating material comprises a vinyl.

7. An adornment device according to claim 4, wherein said coupling means includes a pair of metallic covers for respectively fitting over said pair of retainers, said pair of covers being connectable to each other so as to integrally form said pair of retainers.

8. An adornment device according to claim 4, wherein each of said pair of retainers have means for receiving the bent end portion of the cord and holding the bent portion in the retainer, said receiving and holding means being accessible from the outside when said pair of retainers are separated from each other.

9. An adornment device comprising:

(a) a flexible cord having a plurality of thin wires as a core and an outer cord coating for covering said plurality of thin wires, the outer coating being formed of a flexible, soft-resilient material so as to reduce frictional contact from the cord and to enhance securing of the cord;

(b) a clasp member with a pair of rings for hooking opposite end portions of the flexible cord thereon;

(c) at least one adornment item provided on the flexible cord; and (d) a pair of retainer and securing means, each retainer and securing means positioned adjacent the clasp member and having (i) a cord-threading hole through which an end portion of said cord is inserted for looping around one of the clasp member rings and then back through the same cord-threading hole to protrude from said hole on the outside, (ii) a tap hole disposed substantially in a central position of the retainer and securing means and perpendicular to the cord-threading hole and provided with an internal thread, and (iii) a set screw threadingly fitted in the tap hole and having a set screw end positionable in the cord-threading hole for engaging the outer cord coating of the double-backed cord, the end portion of said cord being securable by the set screw while adjustment of the tension of said cord is being made.

10. The device of claim 9, wherein the set screw end positionable in the cord-threading hole for engaging the cord has a substantially flat surface.

11. The device of claim 9, where the end of the cord-threading hole of the retainer and securing means opposite to the clasp member has an outwarding, expanding outlet.

* * * * *

UNITED STATES PATENT AND TRADEMARK OFFICE

CERTIFICATE OF CORRECTION

PATENT NO. : 4,907,322

DATED : March 13, 1990

INVENTOR(S) : Kiyohiro KANNO

It is certified that error appears in the above-identified patent and that said Letters Patent is hereby corrected as shown below:

Col. 1, line 32, "the knot 102a" should be --the first knot 102a--;

Col. 5, line 4, "13 and the" should be --13a--; and "13, a" should be --13, and the--;

Col. 11, line 1, "75b" should be --75b, and--;

Col. 12, line 39, "stailess" should be --stainless--;

Col. 14, line 7, "an" should be --a--;

line 27, "providied" should be --provided--;

line 30, "outisde," should be --outside,--.

Signed and Sealed this

Tenth Day of March, 1992

*Attest:*

*Attesting Officer*

HARRY F. MANBECK, JR.

*Commissioner of Patents and Trademarks*